United States Patent [19]

Asai et al.

[11] 4,019,683

[45] Apr. 26, 1977

[54] LIQUID ATOMIZING APPARATUS UTILIZING ULTRASONIC WAVE

[75] Inventors: Kiyokazu Asai; Akihiro Takeuchi, both of Nagoya, Japan

[73] Assignee: Kabushiki Kaisha Toyota Chuo Kenkyusho, Japan

[22] Filed: Sept. 30, 1975

[21] Appl. No.: 618,235

[30] Foreign Application Priority Data

Sept. 30, 1974 Japan ..... 49-113149

[52] U.S. Cl. ..... 239/102

[51] Int. Cl.[2] ..... B05B 17/06

[58] Field of Search ..... 239/102, 4; 310/8.2, 310/8.1, 8.7; 261/DIG. 48; 116/137 A

[56] References Cited

UNITED STATES PATENTS

| | | | |
|---|---|---|---|
| 3,147,146 | 9/1964 | Sedlacsik, Jr. | 239/102 X |
| 3,214,101 | 10/1965 | Perron | 239/102 |
| 3,346,189 | 10/1967 | Eisenkraft | 239/102 |
| 3,804,329 | 4/1974 | Martner | 239/102 |

FOREIGN PATENTS OR APPLICATIONS

| | | | |
|---|---|---|---|
| 144,826 | 4/1962 | U.S.S.R. | 239/102 |

*Primary Examiner*—John J. Love
*Attorney, Agent, or Firm*—Oblon, Fisher, Spivak, McClelland & Maier

[57] ABSTRACT

A liquid atomizing apparatus includes an ultrasonic wave transducer connected to an ultrasonic wave oscillator for transforming an electrical oscillation into a mechanical vibration, and a mechanical vibration amplifying member has one end thereof integrally secured to one end of the ultrasonic wave transducer for amplifying the amplitude of the mechanical vibrations transmitted from the ultrasonic wave transducer. An ultrasonic vibratory member of a hollow cylindrical body, which has a predetermined wall thickness, has a portion of its outer circumferential surface integrally secured to the other end of the mechanical vibration amplifying member and a liquid supply means connected to a liquid source for supplying a liquid of a given amount to the circumferential surface of the ultrasonic vibratory member is also provided, the liquid being supplied to the circumferential surface of the ultrasonic vibratory member being atomized upon such circumferential surface of the ultrasonic vibratory member. The liquid atomizing apparatus is capable of atomizing a large amount of liquid upon the outer and/or inner circumferential surfaces of the vibratory member, and achieves a consistent and stable atomization of the liquid while maintaining the size of the atomized liquid particles, and the distribution of the particles, uniform.

36 Claims, 19 Drawing Figures

FIG. 13a
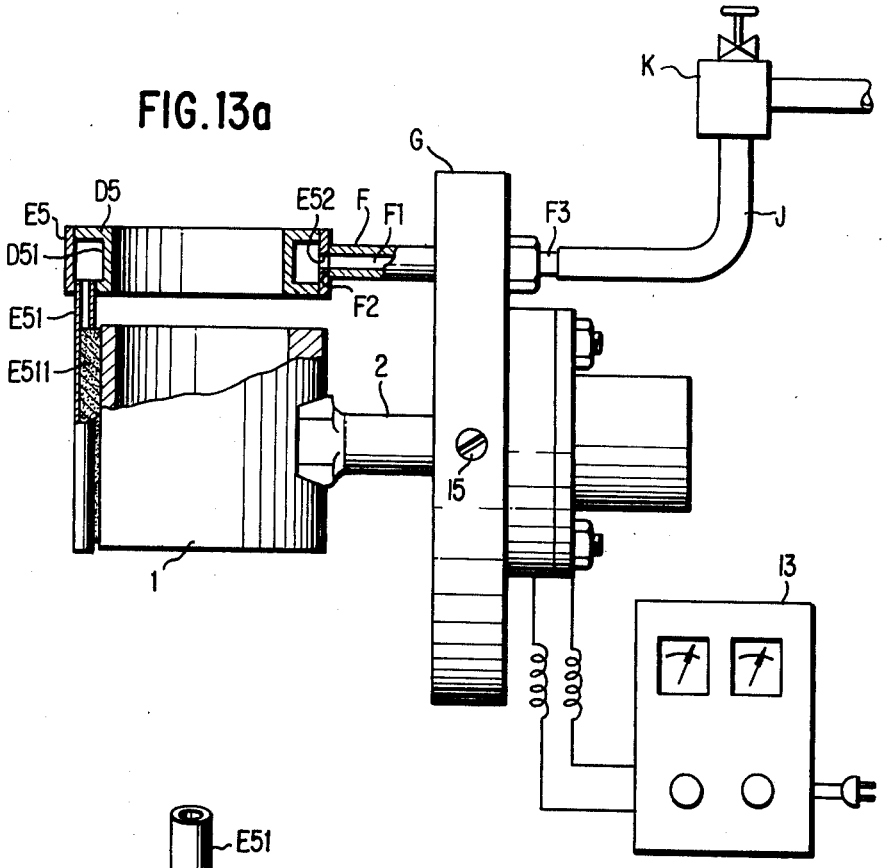
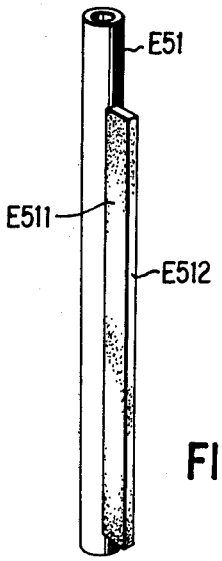
FIG. 13b

LIQUID ATOMIZING APPARATUS UTILIZING ULTRASONIC WAVE

BACKGROUND OF THE INVENTION

1. Field of the Invention:

The present invention relates generally to liquid atomizing apparatus, and more particularly to a liquid atomizing apparatus which utilizes an ultrasonic wave generator having an ultrasonic vibratory member of a hollow cylindrical body.

2. Description of the Prior Art:

A prior art liquid atomizing apparatus utilizing an ultrasonic wave is shown within FIGS. 1(a) – 1(c) as comprising an ultrasonic wave transducer A, an ultrasonic horn B, an ultrasonic wave oscillator C, a liquid amount-adjusting means D, and a liquid supply pipe E. The aforenoted ultrasonic horn B has a nozzle passageway B5 disposed along the longitudinal axis thereof, and a liquid supply passageway B4 which is in communication with the nozzle passageway B5 and which is located at a position at which a node of the longitudinal vibration of the ultrasonic horn exists. Coupled to the mechanical vibration input end B1 of the ultrasonic horn B is the ultrasonic wave transducer A, and the liquid supply pipe E is connected to the liquid supply passageway B4. An electric oscillation produced by means of the ultrasonic wave oscillator C is transformed into a mechanical vibration or a longitudinal vibration by means of the ultrasonic wave transducer A, and subsequently, the vibration thus transformed is in turn transmitted to the ultrasonic horn B whereby the amplitude of the longitudinal vibration is amplified so that the mechanical vibration output end B2 of horn B generates ultrasonic vibrations of a large amplitude. The amount of liquid being supplied is of course adjusted by means of the liquid amount-adjusting means D, and subsequently, the liquid is supplied by means of the liquid supply pipe E, liquid supply passageway B4, and nozzle passageway B5 to the mechanical vibration output end B2 of the horn B. The liquid thus supplied is spread over the vibrating surface due to the ultrasonic vibrations and is then divided into groups of minute liquid particles which division process is followed by sprinkling from the vibrating surface so as to result in the atomization desired.

With the prior art liquid atomizing apparatus utilizing ultrasonic waves, the vibrating surface for atomizing the liquid is embodied within the mechanical vibration output end of the ultrasonic horn, and consequently, the area of the vibrating surface for atomizing the liquid is primarily governed by means of the area of the aforenoted output end. Included as ultrasonic horns which may be utilized within the atomizing apparatus are a conical type shown at B within FIG. 1(a), an exponential type shown within FIG. 1(b), a step type shown within FIG. 1(c), or the like. However, the amplitude amplifying rate within such types of ultrasonic horns depends upon the ratio of the area S1 of the mechanical vibration input end B1 to the area S2 of the mechanical vibration output end B2, that is, S1/S2. Consequently, the smaller the area of the mechanical vibration output end B2, the greater will be the amplifying rate of the vibrational amplitude.

However, in order to amplify the vibrational amplitude to a degree which facilitates sufficient atomization of the liquid, it is required that the area of the mechanical vibration output end B2 be reduced to a value of approximately one tenth of the area of the input end B1. In addition, the diameter of the mechanical vibration input end B1 should not be more than one fourth of the wave length λ of the ultrasonic waves in order to effectively amplify the amplitude of the ultrasonic vibrations. It follows from the foregoing that the prior art liquid atomizing apparatus suffers from the disadvantage that the amount of liquid which may be atomized per unit of time is limited to an extremely small amount due to the aforenoted limitation upon the area of the vibrating surface B2 to be used for atomization of the liquid. For example, in the instance of using an ultrasonic wave of 40 KHz, the diameter of the input end of the ultrasonic horn will be 3 cm, while the diameter of the output end will be 0.9 cm.

Still further, in the instance wherein a liquid is to be atomized by use of ultrasonic vibration and the amount of liquid being supplied is less than such an amount that liquid films, formed as a result of the ultrasonic vibration, are spread over the entire vibrating surface, then the atomizing condition is maintained stable and the distribution of the size of the atomized liquid particles remains unchanged irrespective of the amount of liqid being supplied up to such value. However, if the amount of liquid being supplied is increased to more than the aforenoted amount or value, then the thickness of the liquid films will be increased due to the restricted limitation of the vibrating surface area. Atomization of the liquid is nevertheless achieved, however, if the film thickness exceeds a given value, then the atomizing conditions will be unstable, with the resulting increase in the size of the liquid particles. Therefore, in order to achieve consistent atomization of the liquid having uniformly sized particles, even under the condition wherein the amount of liquid being supplied is increased, it is imperative that the thickness of the liquid films being created upon the vibrating surface be maintained to less than a given value.

Nevertheless, prior art liquid atomizing apparatus have very limited vibrating surface areas, whereupon the thickness of the liquid films created upon the vibrating surface will be increased to a value greater than that desired except under the condition that a very small amount of liquid is being atomized, and consequently, the apparatus fails to achieve the desired stable atomization of the liquid. In addition, with prior art liquid atomizing apparatus, the liquid is supplied directly to the positions which correspond to the crests or antinodes of the vibrational waves, and therefore, in the instance that a large amplitude of vibration is present, there results a sprinkling of extremely large-sized liquid particles.

SUMMARY OF THE INVENTION

Accordingly, it is an object of the present invention to provide a liquid atomizing apparatus which avoids the aforenoted shortcomings experienced with prior art apparatus.

Another object of the present invention is to provide a liquid atomizing apparatus which permits atomization of a large amount of liquid, per unit of time, from the circumferential surface of a hollow cylindrical body within an ultrasonic wave generating means be presenting a large vibrating surface therefor.

Still another object of the present invention is to provide a liquid atomizing apparatus which may atomize a large amount of liquid and control the amount of liquid to be atomized, as required, while maintaining the atomizing conditions constant.

A further object of the present invention is to provide a liquid atomizing apparatus which incorporates operating principles which include subjecting a vibratory member of a hollow cylindrical body to flexural vibrations, which body is secured perpendicularly relative to the axis of a mechanical vibration amplifying member, supplying a liquid to be atomized to the vibratory member along the nodal lines of the flexural vibrations, and controlling the thickness of the liquid film to an optimum value depending upon the amplitude of vibration of the vibrating surface, even if the amount of liquid being supplied is changed, as well as controlling the atomizing area upon the vibrating member in the axial direction thereof. In this manner, consistent and stable atomization of the liquid may be achieved, despite the amount of liquid being supplied, the size of the atomized liquid particles and the distribution of such liquid particles may be maintained uniform, and the sprinkling of liquid particles having an extremely large size may be effectively prevented.

A still further object of the present invention is to provide a liquid atomizing apparatus within which liquid supplied from a liquid supply means is supplied to a vibrating member through means of a member made of a porous material, by utilizing the principle of capillarity, whereby there may be achieved a smooth supply of liquid in amounts varying over a wide range of values, that is, from a very small amount of liquid to a large amount of liquid, while consistent atomization of the liquid may also be attained, even if, for one reason or another, the supply of liquid is intentionally supplied in an intermittent manner.

The foregoing and other objectives are achieved according to a first aspect of the present invention through the provision of a liquid atomizing apparatus which includes an ultrasonic wave transducer operatively connected to an ultrasonic wave oscillator for transforming electrical oscillations into mechanical vibrations, a mechanical vibration amplifying member having one end thereof integrally secured to the ultrasonic wave transducer for amplifying the amplitude of the mechanical vibrations being transmitted from the ultrasonic wave transducer, an ultrasonic vibratory member of a hollow cylindrical body having a predetermined wall thickness and a portion of the outer circumferential surface of which is secured to the other end of the mechanical vibration amplifying member, and liquid supply means connected to a liquid source for supplying liquid of a predetermined amount to either one or both the outer and inner circumferential surfaces of the vibratory member. In this manner, the liquid being supplied to the circumferential surface of the vibratory member and subjected to ultrasonic vibration may be atomized upon the circumferential surface thereof.

In contrast to prior art atomizing apparatus, within which atomization is effected upon or within the tip portion of an ultrasonic horn, the first aspect of the present invention utilizes a vibratory member of a hollow cylindrical body having a large vibrating surface for the purpose of atomizing a large amount of liquid per unit of time. In addition, the first aspect of the present invention also supplies varying amounts of atomized liquid as required, with the atomizing conditions being maintained constant, thereby facilitating wide application of such liquid atomizing apparatus.

According to a second aspect of the present invention there is also provided a liquid atomizing apparatus which includes an ultrasonic wave transducer connected to an ultrasonic oscillator for transforming electrical oscillations into mechanical vibrations, a mechanical vibration amplifying member having one end thereof integrally secured to the ultrasonic wave transducer for amplifying the amplitude of the machanical vibrations transmitted therefrom, an ultrasonic vibratory member of a hollow cylindrical body of a predetermined length and constant wall thickness in the axial direction being open at both ends thereof and being integrally connected to the output end of the mechanical vibration amplifying member with the axis thereof being in perpendicular relation with respect to the axis of the mechanical vibration amplifying member, and liquid supply means connected to a liquid source and having at least two supply ports for supplying to either one or both of the outer and inner circumferential surfaces of the vibratory member with a predetermined amount of liquid along the nodal lines of a wave-like or petaloid flexural vibration upon the circumferential surface of the vibratory member. In this manner, the liquid being supplied to the circumfential surface of the vibratory member and being subjected to the ultrasonic vibrations is sprinkled in a radial direction from the circumferential surface of the member for atomization of the liquid.

In accordance with the second aspect of the present invention, an ultrasonic vibratory member of a hollow cylindrical body is integrally secured at an outer circumferential surface portion thereof to the tip portion of a mechanical-vibration amplifying member which is in turn connected to an ultrasonic wave transducer transforms electrical vibrations into mechanical or longitudinal vibrations. The amplitude of the mechanical vibrations is then amplified by means of the mechanical vibration amplifying member which then transmits the amplified vibrations to the vibratory member of the hollow cylindrical body so as to thereby cause the creation or generation of the proper order of flexural vibrations upon the circumferential surface of the vibratory member at circumferential positions thereof, a liquid being simultaneously supplied to the upper end portion of the vibratory member through a liquid supply means which is adapted to supply the liquid through a plurality of supply ports along the nodal lines of the flexural vibrations. As a result, the liquid supplied to either one or both of the inner and outer circumferential surfaces of the vibratory member which is being subjected to the flexural vibrations is accordingly atomized.

In this respect, the dimensions of the vibratory member should be such as to cause resonance at the frequency of the electrical oscillations being imparted to the elements of the transducer, and as the aforenoted dimensions are dependent upon two factors, that is, frequency and the order of flexural vibration, the dimensions may be freely changed by optionally selecting the order of the flexural vibrations, and thus, atomization can be effected upon a large vibrating surface of a vibratory member of a hollow cylindrical body.

Further, the liquid to be atomized is supplied from one end portion of the vibratory member along the nodal lines of the flexural vibration, that is, along a plurality of lines disposed upon the circumferential surface of the vibratory member, the vibratory displacement of which is maintained at zero, and such lines extend over the entire axial length of the vibratory member. In this manner, the liquid thus supplied is attracted at the nodal lines and upon the vibrating surface so as to thereby create liquid films due to the ultrasonic vibration thereof, which phenomeon is followed by sprinkling and atomization, the thickness of the liquid films being automatically controlled to an optimum thickness depending upon the vibrational amplitude of the vibrating surface. As a result, an increase or decrease in the amount of liquid being supplied only results in an automatic increase or decrease in the extent of the liquid films being created in the axial direction upon the circumferential surface of the cylindrical body, with the thickness of the liquid films remaining constant and uniform. Accordingly, there may be achieved stable liquid atomization with uniform distribution of the atomized liquid particles, despite the amount of liquid being supplied.

Still yet further in accordance with the second aspect of the present invention, liquid is supplied to the nodal vibration positions so that even if the amplitude of vibration is increased, there may not result a sprinkling of liquid particles having an extremely large size within the supply areas of the liquid as has been experienced within the prior art apparatus.

According to the third aspect of the present invention, there is provided a liquid atomizing apparatus which includes an ultrasonic wave transducer connected to an ultrasonic wave oscillator for transforming the electrical oscillations into mechanical vibrations, a mechanical vibration amplifying member having one end thereof integrally secured to one end of the ultrasonic wave transducer for amplifying the amplitude of the mechanical vibrations transmitted from the ultrasonic wave transducer, an ultrasonic vibratory member of a hollow cylindrical body having a predetermined wall thickness and a portion of its outer circumferential surface being secured to the other end of the mechanical vibration amplifying member, and liquid supply means for supplying a predetermined amount of liquid to either one or both of the outer and inner circumferential surfaces of the vibratory member through means of a member made of a porous material and abutting the particular circumferential surface thereof. In this manner, liquid is smoothly supplied to the particular circumferential surface of the vibratory member which is subjected to the ultrasonic vibrations for atomization of the liquid upon the particular circumferential surface.

According to the third aspect of the present invention having the aforenoted structural arrangement, the liquid is supplied by means of the liquid supply means to the vibratory member through means of the member made of a porous material and utilizing the capillarity characteristics thereof, and consequently, predetermined amounts of the liquid, which may vary over a wide range of values, that is, from a very small amount of liquid to a large amount of liquid, may be supplied in a smooth manner thereby achieving uniform atomization of the liquid even in the instance that the supply of the liquid is carried out, intentionally or unintentionally, in an intermittent manner for one reason or another.

BRIEF DESCRIPTION OF THE DRAWINGS

Various other objects, features, and attendant advantages of the present invention will be more fully appreciated as the same becomes better understood from the following detailed description when considered in connection with the accompanying drawings, in which like reference characters designate like or corresponding parts throughout the several views, and wherein:

FIG.. 13(a) is a schematic view, partly in cross section, of a sixth embodiment of the present invention, and FIG. 13(b) is a perspective view of the porous member structure utilized within the apparatus of FIG. 13(a);

DETAILED DESCRIPTION OF THE ILLUSTRATED EMBODIMENTS

Figure 1A:
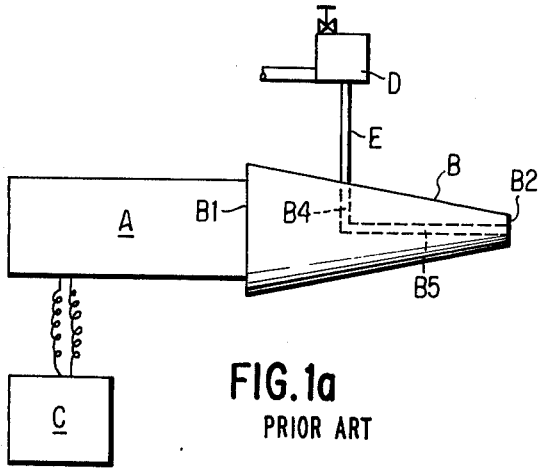
FIG.1a PRIOR ART
FIGS. 1(a) – 1(c) are schematic views of a prior art liquid atomizing apparatus utilizing an ultrasonic wave.
Figure 1B:
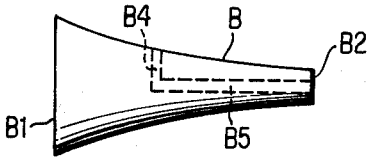
FIG.1b PRIOR ART
Figure 1C:
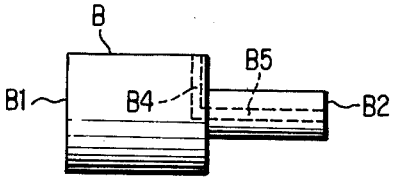
FIG.1c PRIOR ART
Figure 2:
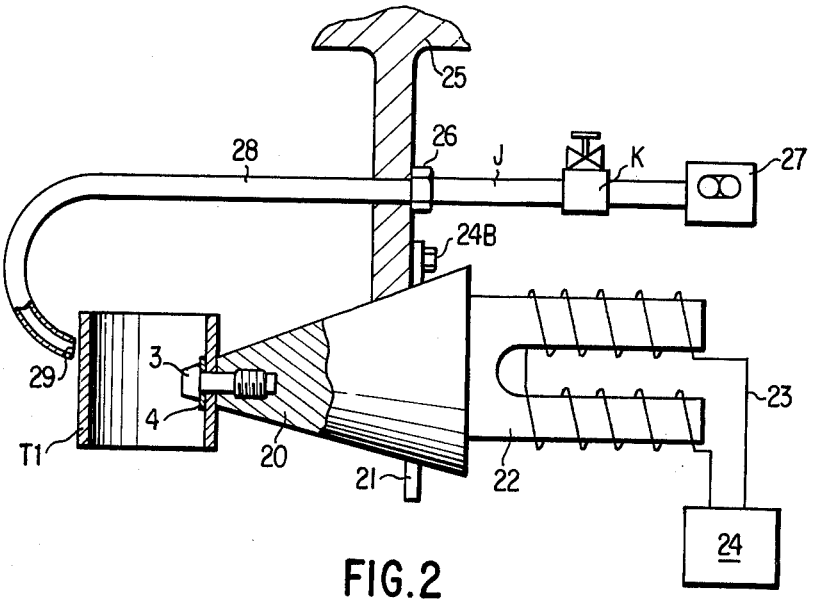
FIG. 2 is a schematic view, partly in cross-section, of a first embodiment of a liquid atomizing apparatus constructed in accordance with the present invention and showing its cooperative parts.
Figure 3:
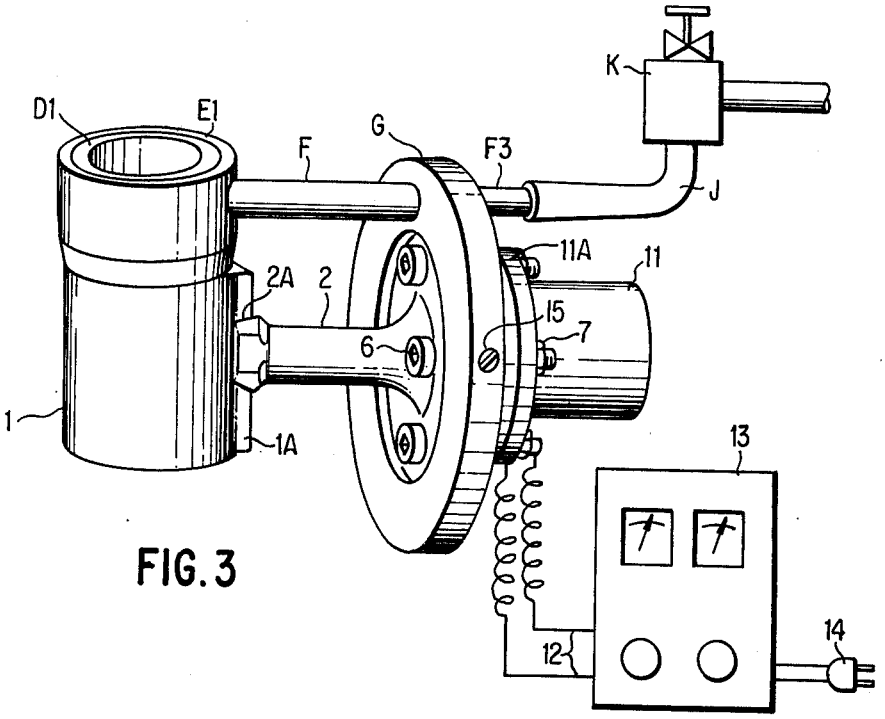
FIG. 3 is a perspective view of a second embodiment of the liquid atomizing apparatus utilizing an ultrasonic wave constructed in accordance with the present invention.
Figure 4:
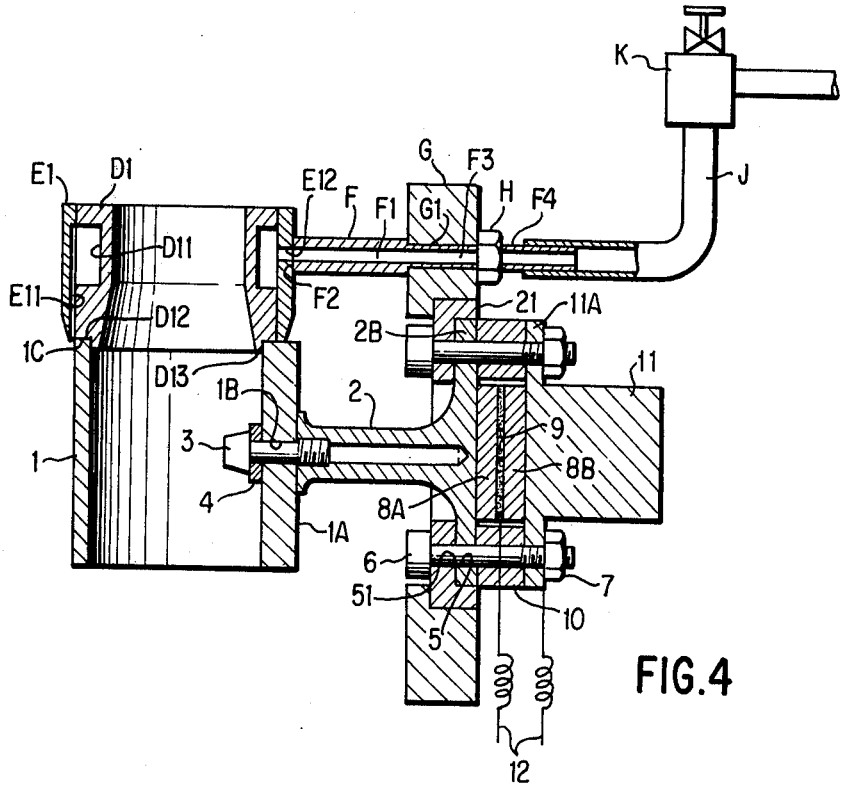
FIG. 4 is a cross-sectional view of the liquid atomizing apparatus of FIG. 3.
Figure 5:
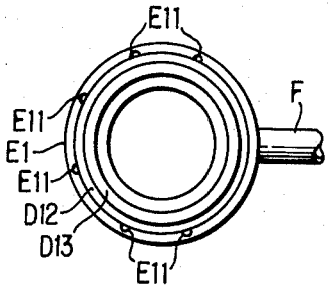
FIG. 5 is a partial plan view of the liquid supply apparatus of FIG. 4.

Referring now to the drawings and more particularly to FIG. 2 thereof, a first embodiment of a liquid embodiment of a liquid atomizing apparatus utilizing an ultrasonic wave is seen to include, in serial fashion, an ultrasonic wave transducer having a magnetostrictive element 22, a mechanical vibration amplifying portion consisting of a conical type horn 20, an ultrasonic vibratory member consisting of an elliptical, hollow cylindrical body T1 having a small wall thickness, and a liquid supply means consisting of a single hollow pipe 28 which is connected to a liquid source.

The ultrasonic wave transducer consists of a forked or pronged magnetostricitve element 22 around which is wound a predetermined number of turns of a lead wire 23 which is connected to an oscillator 24 for generating the ultrasonic waves. The mechanical vibration amplifying portion consists of the conical type horn 20 integrally bonded to the magnetostrictive element 22, and a supporting plate 21 is secured to the horn 20 at a position at which the longitudinal vibration becomes zero, that is, in the nodal position, and is likewise secured to a housing 25 by means of a bolt 24B.

The vibratory member consists of the elliptical, hollow cylindrical body T1 of small wall thickness, with its axis being disposed perpendicular to the longitudinal axis of horn 20 and with one portion of its outer circumferential wall surface being secured to the tip or apex portion of the horn 20 by means of a bolt 3 and a washer 4. The outer circumferential surface of the vibratory member serves as an effective atomizing portion, the dimensions of the surface being predetermined so as to provide a sufficient vibrating surface depending upon the desired amount of liquid to be atomized. The liquid supply means is likewise seen to consist of a liquid supply amount-adjusting means or valve K adapted to supply a predetermined amount of liquid from a pumping means 27, a liquid supply pipe J secured to the housing 25 by means of a nut 26 and connected to the adjusting means K, and the hollow pipe 28 is in communication with the pipe J at one end thereof and which has an opening 29, of a predetermined diameter, at the other end thereof which is directed in a downwardly inclined manner toward the upper portion of an effective atomizing portion of the vibratory member T1, the effective atomizing portion being determined by or dependent upon the amount of liquid to be atomized.

It is thus apparent that in accordance with the first embodiment of the atomizing apparatus having the structural arrangement described hereinabove, the oscillator 24 transmits an electric oscillation, having a predetermined frequency, to the magnetostrictive element 22 whereupon the magnetostrictive element 22 transforms the electric oscillation thus produced into mechanical vibrations and transmits the same to the conical horn 20 to thereby amplify the amplitude of vibration whereby the vibratory member T1 vibrates with a predetermined amplitude. Concomitant therewith, a liquid is supplied from pumping means 27 and metered by means of the adjusting means K and is in turn supplied to the outer circumferential surface, that is, the effective atomizing portion of the vibratory member T1 which is subjected to vibration at constant predetermined amplitude, by means of the liquid supply pipe J and the hollow pipe 28. The liquid supplied to the upper portion of the vibratory member T1 is then of course discharged for atomization thereof by means of the vibrating surface of member T1 which is subjected to the ultrasonic vibrations, the effective area of the vibrating surface being determined by the circumferential extent of the effective atomizing portion and the axial length of the vibrating member T1.

It is thus seen that in contrast to the prior art apparatus, the atomizing apparatus of the first embodiment effects atomization of the liquid by means of a vibrating surface having a sufficiently large area which is governed by the dimensions of the outer circumferential surface area of an elliptical cylindrical body, thereby enabling atomization of a great amount of liquid per unit of time, as well as atomization of a desired amount of liquid by changing the amount of liquid being supplied in accordance with the accompanying desired atomizing condition.

A detailed description will now be given of a second embodiment of the present invention which is likewise concerned with liquid atomizing apparatus using ultrasonic waves, and with particular reference being made to FIGS. 3–7, the atomizing apparatus of the second embodiment is provided with an ultrasonic wave generator within which piezoelectric elements are sandwiched between a first metal block for use as a backing means and a second metal block for use in amplifying the ultrasonic vibrations, the latter metal block being of a stepped horn type serving as a mechanical amplifying portion, and secured in position by means of suitable fastening means. A vibratory member of a hollow cylindrical body is integrally secured to the tip portion of the vibration amplifying metal block, and in this manner, the ultrasonic vibration-amplifying block serves as an ultrasonic wave transducer with the aid of the piezoelectric elements and the metal backing block, and at the same time, also serves as a horn which amplifies the mechanical vibrations produced within the ultrasonic wave transducer. The liquid atomizing apparatus of the second embodiment therefore consists of an ultrasonic wave generator, which is adapted to subject the vibratory member of the hollow cylindrical body to wave-like or petaloid flexural vibrations, as well as a liquid supply means.

The vibratory member of the hollow cylindrical body 1 within the ultrasonic wave generator is formed upon its outer circumferential surface with a columnar portion having a large wall thickness in cross section, that is, a rib 1A which is integral with the cylindrical body over its entire length and which extends in a direction parallel with the longitudinal axis of the cylindrical body, the rib 1A being formed with a bore 1B adapted to receive therethrough a bolt having a truncated conical head. The cylindrical body 1 is secured by means of a bolt 3 to the metal block 2, which is provided for amplifying the ultrasonic wave vibrations, in such a manner that the axis of the cylindrical body 1 is disposed perpendicular to the vibrating direction of the block 2, bolt 3 being threadedly engaged with block 2 from the inner wall surface of the cylindrical body 1 into a mechanical vibration output end 2A of block 2 through means of a washer 4. The metal block 2 consists of a stepped type horn serving as the mechanical vibration amplifying portion and having a T-shaped cross section, and the mechanical vibration output end 2A thereof is formed so as to have a configuration which is adapted for accomplishing intimate contact with the side surface of the rib 1A of the cylindrical body 1.

The base portion of the block 2 is formed with a flange 2B within which is defined a plurality of bolt holes 5, and an annular support plate 21 is disposed upon and over flange 2B for reinforcing the bending rigidity thereof. The support plate 21 is formed with holes 51 which are adapted to register with bolt holes 5 of flange 2B, and the plate is integrally secured, by means of bolts 6, which pass through holes 51 and 5, and nuts 7 to a flange 11A of a metal backing block 11 which block faces the supporting plate 21, flange 2B, piezoelectric elements 8A and 8B, electrode plate 9 and a spacer plate 10 being sandwiched therebetween. The annular support plate 21 of the ultrasonic wave generator is also disposed within a support plate G of the liquid atomizing apparatus and is secured therein by means of locking screws 15.

The liquid supply means is seen to include an annular liquid supply ring D1 secured atop body 1, a hollow support plate G at the other end thereof, and a liquid supply amount-adjusting means or valve K which is in communication with a liquid supply pipe J, and a liquid source, not shown. The annular liquid supply ring D1 consists of an annular member whose outer diameter is substantially equal to the outer diameter of the cylindrical body 1 of the ultrasonic wave generator, and an annular groove D11, having a rectangular cross-section, is defined within the outer circumferential surface of the liquid supply ring D1. The lower end surface D12 of the liquid supply ring D1 which seats upon the upper end face 1C of the cylindrical body 1 of the ultrasonic wave generator is formed with an inner annular flange portion D13 which is adapted to mate with the circumferential end surface of cylindrical body 1, a minute gap remaining therebetween.

An outer ring E1 is intimately secured upon the outer circumferential surface of the liquid supply ring D1 in such a manner as to cover the annular groove D11 and thereby define a liquid chamber therein, members E1 and D1 being bonded together by suitable means, such as for example, brazing. In addition, eight slit-like grooves E11, only six of which are shown, of small cross-sectional area, are defined within the inner circumferential surface of the outer ring E1 so as to extend in the axial direction thereof, and the positions of the grooves are such as to correspond to eight positions 1E1 at the upper end of the outer circumferential surface of cylindrical body 1 at which will be located the nodes of vibration created upon the cylindrical body 1 within the fourth order of flexural vibration, to be described in greater detail hereinafter, when liquid supply ring D1 is fitted upon the end face 1C of the cylindrical body of the ultrasonic wave generator.

In this manner, the ends of the grooves E11 located at the end of ring E1 which faces the cylindrical body 1 of the ultrasonic wave generator are open, while the other ends of the grooves E11 are closed although the latter ends are in communication with the annular groove D11 defined within the liquid supply ring D1. The outer ring E1 is also secured to the end face F2 of the support rod F having a liquid supply passage F1 defined therein along the longitudinal axis thereof, the liquid supply passage F1 being in registry with a liquid communicating port E12 defined within the outer ring E1.

The support rod F includes a reduced diameter portion F3 which extends through a support rod support-bore G1, defined within the support plate G, so as to facilitate the attachment of rod F to support plate G by means of a threaded portion F4, formed upon the reduced diameter portion F3, and a nut H which is threadedly engaged upon threaded portion F4. In this manner, the lower portion D12 of the liquid supply ring D1 is in a non-tensioned abutment condition with the upper end face 1C of the cylindrical body 1 of the ultrasonic wave generator, while the annular projecting or flange portion D13 is disposed interiorly of the inner circumferential surface of the cylindrical body 1 of the ultrasonic wave generator, with a minute gap remaining therebetween. The liquid supply amount-adjusting means K controls the liquid flowing into the liquid supply pipe J which is connected to the end of the reduced diameter portion F3 of support rod F having the liquid supply passage F1 defined therethrough. Accordingly, liquid to be atomized will be supplied through grooves E11 to the nodal positions of vibration created upon the outer circumferential surface of the cylindrical body 1 of the ultrasonic wave generator.

The piezoelectric elements 8A and 8B are disposed with their positive poles facing each other, with the electrode plate 9 interposed therebetween and the negative poles of the elements 8A and 8B are in contact with the flanges 2B and 11A respectively. The spacer plate 10 is an annular body made of silicon rubber and formed with through-holes which allow bolts to be inserted therethrouh, plate 10 also serving to house the piezoelectric elements 8A and 8B as well as electrode plate 9, within its central portion, whereby the assembly comprising plate 10, together with members 8A and 8B, may be secured between the flanges 2B and 11A by means of the bolts 6 and nuts 7. Connected to the electrode plate 9 and flange 11A are electric oscillation input lead wires 12 which in turn are connected to the output side of the ultrasonic wave oscillator 13, the input side thereof being connected to an electrical connector plug 14 which is connected to an electric power source, not shown.

In this respect, the ultrasonic wave oscillator is so constructed as to generate electric oscillations having a predetermined frequency, and the ultrasonic wave transducer, the mechanical vibration amplifying member, and the ultrasonic vibratory member are constructed so as to have predetermined dimensions such that the circumferential surface of the ultrasonic vibratory member is subjected to flexural vibration. In more detail, the cylindrical body 1, metal block 2 for amplifying the ultrasonic vibrations, piezoelectric elements 8A and metal backing block 11, when assembled, are so designed as to cause resonance at a given frequency, and in order to accomplish this, the length of the ultrasonic vibration amplifying metal block 2, extending from the tip of the mechanical-vibration output end 2A to the end of the flange 2B disposed upon the side of the annular support plate, is so designed as to be one-fourth of the wave length $\lambda$ of the ultrasonic waves to be transmitted, while the length of the metal backing block 11 is determined by calculations or experiments such that the end face of the flange 2B disposed upon the side of the annular supporting plate is located within the nodal vibration positions. In addition, the ultrasonic wave oscillator 13 is so designed as to transmit electric oscillations, having the aforenoted resonance frequency, to the piezoelectric elements 8A and 8B.

The operation of the second embodiment of the apparatus of the present invention, which has the aforenoted arrangement, will now be described. When the ultrasonic wave oscillator 13 is connected to the electric power source so as to energize the same, the oscillator 13 imparts electric oscillations, having the same frequency as the resonant frequency of the ultrasonic wave generator, to the piezoelectric elements 8A and 8B so as to in turn cause mechanical vibration of the same. The mechanical vibrations thus produced causes the ultrasonic vibration amplifying metal block 2 to effect longitudinal vibrations of the type having the vibrational nodes at the end face of the flange 2B upon the side of the annular support plate 21. In this manner, the block 2 amplifies the amplitude of the vibrations so that the vibrational displacement having the amplitude is in turn transmitted from the mechanical vibration output end 2A of block 2 to the cylindrical body 1 of the ultrasonic wave generator through means of the rib 1A.

Figure 6:
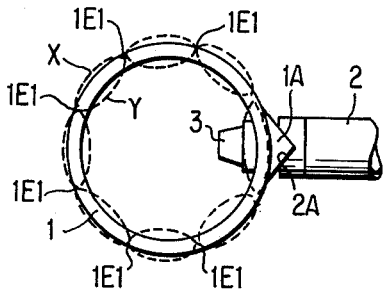
FIG. 6 is a partical plan view of the ultrasonic wave generating apparatus of FIG. 4.
Figure 7A:
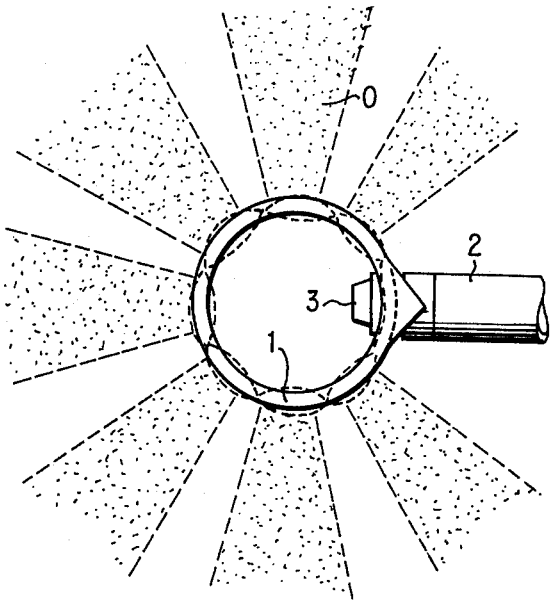
FIGS. 7(a) and 7(b) are schematic plan and side elevation views showing the operation of the apparatus of FIG.3.
Figure 7B:
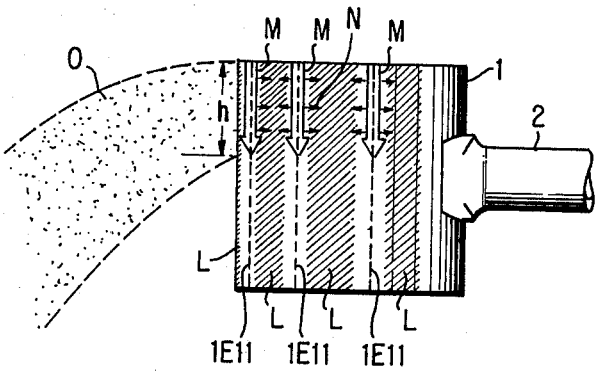

Accordingly, within this embodiment wherein the cylindrical body 1 is so designed as to be subjected to the fourth order of the wave-like or petaloid flexural vibrations, the vibrations form or follow a half cycle pattern as shown by the dotted line X within FIG. 6, while the vibrations also form or follow a similar pattern Y which however is out of phase with respect to the X vibrations, at each subsequent half cycle. For example, in the instance of a frequency of 40 KHz, the vibrations will be repeated 40,000 cycles per second. Subsequently, when the valve within the liquid supply amount-adjusting means K is opened so as to supply liquid to be atomized, the liquid will be supplied by means of the liquid supply pipe J and the liquid supply passage F1 to the annular groove D11 within the liquid supply ring D1.

Furthermore, liquid will flow out through the nozzle grooves E11, which are in communication with the annular groove D11, toward the end portion of the cylindrical body 1 of the ultrasonic wave generator and along the outer circumferential surface of the cylindrical body in the axial direction thereof. It should be noted that since the nozzle grooves E11 are disposed at the positions corresponding with the positions 1E1, located upon the upper portion of the outer circumferential surface of the cylindrical body, at which the vibrational nodes occur, when the cylindrical body 1 is subjected to the fourth order of the flexural vibrations, the liquid will be supplied along the nodal lines of vibration, and the liquid will of course be atomized due to the ultrasonic vibration of the cylindrical body. The condition will be described in greater detail with reference to FIGS. 7(a) and 7(b).

Liquid supplied to the nodal vibration positions flows along the nodal lines upon the outer circumferential surface of the cylindrical body 1 as shown by the dotted lines 1E11, and the liquid M flowing along the nodal lines is seen to be attracted, upon the vibrating surface in the directions shown by the plurality of arrows N, towards the crest portions of the waves of vibration which portions L are positioned upon both sides of each nodal line, and consequently, liquid films are formed upon the vibrating surface. Subsequently, the films are divided into groups of minute liquid particles which upon being atomized, sprinkle radially from the vibrating surface as shown at O.

In this respect, liquid films are formed upon the vibrating surface by attracting liquid portions from the nodal lines towards the crests of the vibrational waves due to the ultrasonic vibration of the apparatus, and it is to be noted that the thickness of the liquid films is governed by means of the amplitude of the vibration. In addition, if the amount of liquid being supplied is reduced, the height $h$ of the liquid films formed upon the cylindrical body and that of the effective atomization area thereof, will be decreased, whereas an increase in the amount of liquid being supplied leads to a corresponding increase in such a parameter. In other words, the height $h$ of the liquid films formed and of the liquid being atomized is automatically increased or decreased along the axial extent of the cylindrical body, depending upon the amount of liquid being supplied, while the thickness of the liquid films are automatically controlled to an optimum thickness which facilitates the most effective atomization of the liquid depending upon the amplitude of vibration of the vibrating surface. Accordingly, the liquid atomizing apparatus within the second embodiment of the present invention presents a distinct advantage in that optimum atomization of the liquid may be obtained depending upon the amount of liquid being supplied.

As was the case with respect to the first embodiment, the apparatus of the second embodiment facilitates the atomization of a large amount of liquid per unit of time, and in addition, effects atomization of a desired amount of liquid as well as performing such atomization under desired and controlled conditions. Still further, the apparatus of the second embodiment provides an ultrasonic vibration amplifying metal block as one of the functional elements of the ultrasonic wave transducer which in fact functions so as to inherently provide amplification of mechanical vibration, and in this manner, the size of the apparatus may be rendered considerably compact which presents the viable possibility of the application of the apparatus of the present invention to fields within which there is a substantial limitation in available space.

Figure 8:
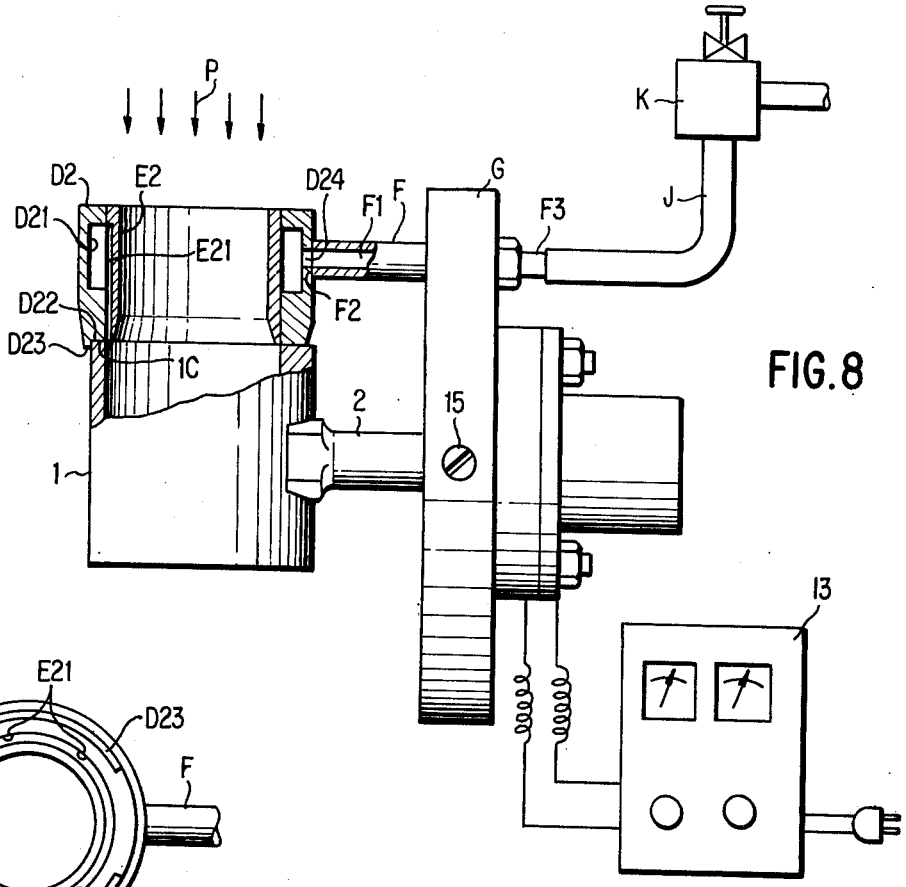
FIG. 8 is a schematic view, partly in cross-section, of a third embodiment of the apparatus of the present invention.
Figure 9:
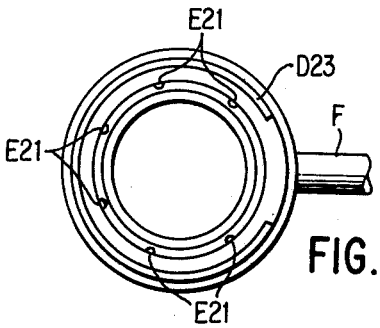
FIG. 9 is a partial plan view showing the liquid supply apparatus of FIG. 8.
Figure 10:
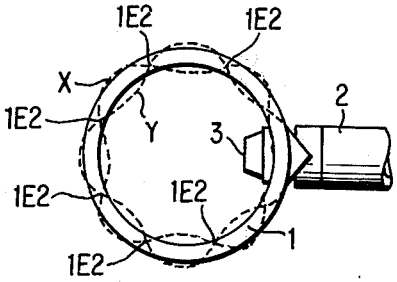
FIG. 10 is a partial view showing the ultrasonic wave generating apparatus of FIG. 8.

Turning now to FIGS. 8–10, a third embodiment of an atomizing apparatus utilizing an ultrasonic wave will be described, and it should be noted that the primary difference between the second and third embodiments of the present invention is the fact that within the third embodiment, liquid is supplied to the inner circumferential surface of the cylindrical body 1 of the ultrasonic wave generator, as opposed to the exterior surface thereof. As will be seen from such FIGS., an annular liquid supply ring D2 of the liquid supply means includes an annular member whose inner diameter is substantially the same as that of the vibratory member 1 comprising the hollow cylindrical body within the ultrasonic wave generator, and an annular groove D21, having a substantially rectangular configuration in cross section, is defined within the inner circumferential surface thereof.

The lower end face D22 of the liquid supply ring D2, which face is in contact with the upper end face 1C of the cylindrical body 1 within the ultrasonic wave generator, is formed with a substantially annular projecting flange portion D23 in such a manner that a minute gap remains between the projecting portion D23 and the upper portion of the outer circumferential surface of the cylindrical body 1 within the ultrasonic wave generator. Disposed within and secured upon the inner circumferential surface of the liquid supply ring D2 is an inner ring E2 comprising an annular ring member of small wall thickness and covering the annular groove D21 so as to define an annular chamber with ring D2, the members D2 and E2 being bonded to each other, by suitable bonding means such as, for example, brazing, in a liquid-tight manner.

In addition, eight slit-like grooves E21, only six of which are shown, having a small cross section, are defined within the outer circumferential surface of the inner ring E2 so as to extend in the axial direction thereof. The positions of the grooves E21 are such as to correspond and be in registry with the eight positions 1E2 of the nodes of vibration generated upon the upper portion of the inner circumferential surface of the cylindrical body 1 when the liquid supply ring D2 is secured and fitted upon the end face 1C of the cylindrical body 1 within the ultrasonic wave generator, the aforenoted nodes of vibration being created in accordance with the aforenoted fourth order of flexural vibration and located equiangularly about or along the circumference of the cylindrical body 1. In this manner, the end of each of the grooves E21 which is disposed facing the cylindrical body 1 within the ultrasonic wave generator is open, while the other end of each of the grooves is closed but is in communication with the annular groove D21 of the liquid supply ring D2.

The liquid supply ring D2 is coupled at a portion of its outer circumferential surface to one end face F2 of support rod F having a liquid supply passage F1 axially defined therethrough, the liquid supply passage F1 being in registry with a liquid inlet port D24 which is in turn defined within the liquid supply ring D2. Furthermore, as in the case of the second embodiment, the support rod F is secured to a support plate G within the liquid atomizing apparatus, and in this manner, the end face D22 of the liquid supply ring D2 is seated upon the end face 1C of the cylindrical body 1 of the ultrasonic wave generator, while the partly broken, substantially annular projecting portion D23 is fitted upon and about the outer circumferential surface of the cylindrical body 1 with a minute gap remaining therebetween.

A liquid supply amount-adjusting means K is also provided, and one end of a liquid supply pipe J is in fluidic communication with the liquid supply amount-adjusting means K while the other end thereof is in communication with the end portion of a small diameter portion F3 of the support rod F having the liquid supply passage F1 therewithin. Accordingly, the liquid to be atomized is supplied through the means of the grooves E21 to the nodal vibration positions located upon the inner circumferential surface of the cylindrical body 1 of the ultrasonic wave generator. It is to be noted further that the structure and construction of this embodiment, other than that described hereinabove, is the same as that of the first embodiment.

A description of the operation of the liquid atomizing apparatus of the third embodiment having the aforenoted structural arrangement, will now be given. As with the second embodiment, when the ultrasonic wave oscillator 13 is energized, the cylindrical body 1 of the ultrasonic wave generator is subjected to flexural vibration, and subsequently, the valve within the liquid supply amount-adjusting means K may be opened so as to feed the liquid to be atomized. The liquid is supplied by means of the liquid supply pipe J and the liquid supply passage F1 of rod F to the annual groove D21 of the liquid supply ring D2, and subsequently, the liquid flows through the eight slit-like grooves E21 of ring E2, which are of course in communication with the annular groove D21, toward the end portion of the cylindrical body 1 and along the inner circumferential surface thereof in the axial direction. In this manner, the liquid is supplied along the nodal lines since the positions of the eight slit-like grooves E21 register with the eight positions 1E2 of the vibrational nodes upon the upper end portion of the inner circumferential surface of the cylindrical body when the body 1 is subjected to the fourth order of flexural vibration. As a result, the liquid which flows along the nodal lines upon the inner circumferential surface of the cylindrical body 1 being subjected to the flexural vibration is attracted to the crests of the vibrational waves, as in the second embodiment, which crests are positioned upon both sides of each node, and consequently, liquid films are formed upon the vibrating surface and subsequently divided into groups of minute liquid particles, followed by sprinking toward the interior portion of the cylindrical body for atomization.

It is thus seen that within this embodiment as well, liquid films are formed upon the vibrating surface as a result of the liquid being attracted from the nodal lines, due to the ultrasonic vibration, and the thickness of the liquid films is automatically controlled to an optimum value which facilitates the most effective atomization of the liquid due to ultrasonic vibration, as in the case with the second embodiment. Furthermore, with this embodiment, since atomization of the liquid is carried out internally of the cylindrical body, it is desirable that an air stream shown at P be introduced into body 1 so as to flow into the interior portion of the cylindrical body 1 and interiorly of the liquid supply ring D2, thereby accelerating the discharge of the atomized liquid particles from the cylindrical body to the area exterior thereof. In addition to this, since atomization of the liquid is performed internally of the cylindrical body 1 within the third embodiment of the apparatus, this is best suited for applications wherein atomization must or should be carried out in a limited space. This embodiment therefore affords advantages similar to those of the second embodiment, in addition to those just described hereinabove.

Figure 11:
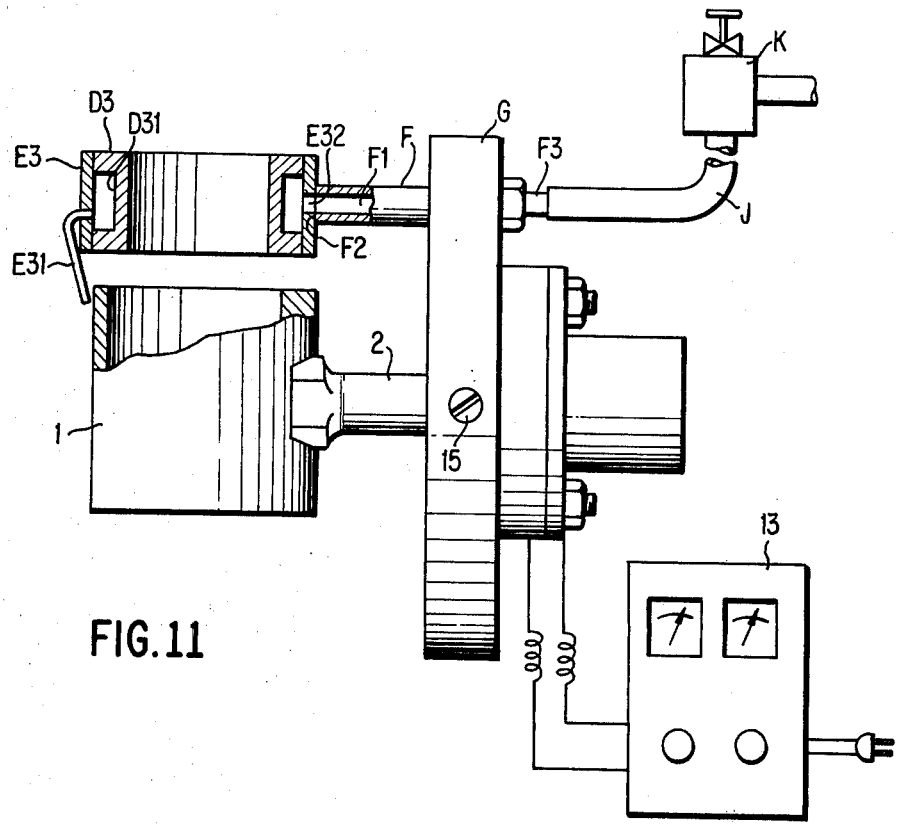
FIG. 11 is a schematic view, partly in cross section, of a fourth embodiment of the apparatus of the present invention.

A description will now be given of a liquid atomizing apparatus utilizing ultrasonic waves in accordance with a fourth embodiment of the present invention, which is a still further modification of the second embodiment, with particular reference being made to FIG. 11. The fourth embodiment of the apparatus of the present invention is intended to generate a third order flexural vibration and supplies the liquid through means of small diameter pipes to the vibratory member having a hollow cylindrical body, which is substantially different from the structure of the second and third embodiments. Defined within the outer circumferential surface of the annular liquid supply ring D3 is an annular groove D31 having a substantially rectangular cross-section, and closely secured upon the outer circumferential surface of the liquid supply ring D3 is an outer ring E3 covering the annular groove D31 so as to define an annular fluid supply chamber with member D3, both members D3 and E3 being bonded to each other by suitable means, such as, for example, brazing.

The outer ring E3 is coupled, at one portion of its outer circumferential surface, to an end face F2 of a support rod F having a liquid supply passage F1 axially defined therethrough, the liquid supply passage F1 being in registry with a liquid inlet port E32 defined within the outer ring E3. The liquid supply ring D3 is thus secured to a support plate G within the liquid atomizing apparatus by means of the support rod F at a position axially spaced a given distance from the end face of the cylindrical body 1 and with the axis thereof being in coincidence with that of the cylindrical body 1. In addition, there are also provided integrally with the outer ring E3 six thin tubes E31, having a small diametrical cross-section, which extend downwardly from the outer ring E3 toward body 1, with one end of each of the nozzle tubes or pipes E31 being in communication with the annular groove D31, while the other end of each of the thin tubes E31 is disposed so as to face the upper end portion of the outer circumferential surface of the cylindrical body 1.

In this manner, the dispositions of the tips of the thin tubes are such as to correspond and register with the six positions of the vibrational nodes generated upon the circumferential surface of the cylindrical body when the cylindrical body 1 of the ultrasonic wave generator is subjected to the third order of flexural vibration, and in addition, the tips of the thin tubes are inclined downwardly at a predetermined angle towards the outer circumferential surface of the cylindrical body 1 in such a manner that the liquid may be supplied along the nodal lines upon the outer circumferential surface of the cylindrical body wich is being subjected to the third order of flexural vibration.

Accordingly, the liquid atomizing apparatus utilizing an ultrasonic wave in accordance with the fourth embodiment of the present invention as set forth hereinabove achieves the desired atomization of the liquid, as in the case with the embodiment, by supplying the liquid along the nodal vibrational lines generated upon the exterior surface of the vibrating member 1 through means of the small diameter tubes E31, automatic control of the liquid films to an optimum thickness, as well as the control of the atomizing area, as a function of the amount of liquid being supplied, also being achieved, and still further, the atomization of a large amount of liquid having a uniform atomized particle size and distribution, and provision of the desired amount of liquid to be atomized, is likewise obtained.

Figure 12:
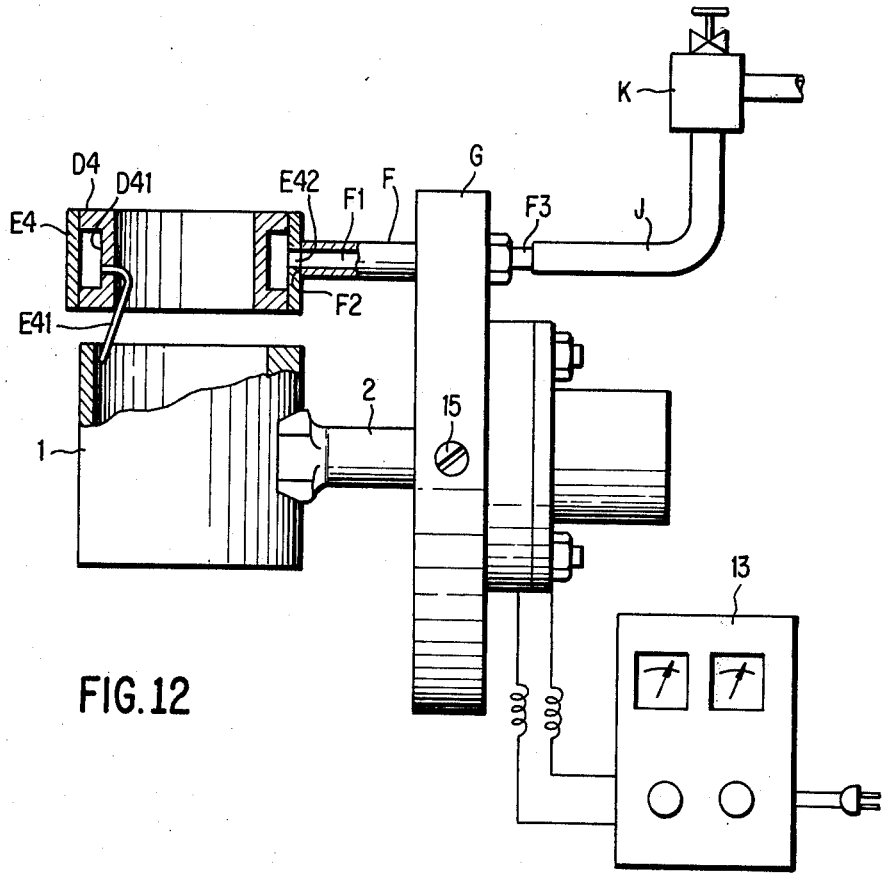
FIG. 12 is a schematic view, partly in cross section, of a fifth embodiment of the present invention.

Turning now to FIG. 12, a detailed description will now be given of a liquid atomizing apparatus utilizing an ultrasonic wave in accordance with a fifth embodiment of the present invention which is also structurally related to the second embodiment of the present invention. As will become apparent, the fifth embodiment likewise features the supply of the liquid through means of small-diameter or thin tubes operably disposed in conjunction with the vibrating member 1 of the hollow cylindrical body of the ultrasonic wave generator, the liquid being supplied however to the inner circumferential surface of the cylindrical body as in the case of the third embodiment. An annular groove D41 is defined within the outer circumferential surface of an annular liquid supply ring D4, and secured upon the outer circumferential surface of the liquid supply ring D4, in a closely related manner, is an outer ring E4 which covers the annular groove D41 so as to define with member D4 an annular liquid supply chamber, the member D4 and E4 being bonded to each other by suitable means such as, for example, brazing.

The outer ring E4 is coupled at one portion of its outer circumferential surface to an end face F2 of a support rod F having a liquid supply passage F1 axially defined therethrough, the liquid supply passage F1 being in registry with a liquid inlet port E42 which is defined within the outer ring E4. The liquid supply ring D4, whose axis is in coincidence with that of the cylidrical body 1 of the ultrasonic wave generator, is secured, at a position axially spaced a given distance from the upper end face of the cylindrical body 1, to a support plate G within the liquid atomizing apparatus by means of the support rod F.

A plurality of small diameter or thin tubes E41 are provided integrally with the annular liquid supply ring D4, one end of each of the pipes E41 being in fluidic communication with the annular groove D41 while the other end thereof projects downwardly so as to face the upper end portion of the inner circumferential surface of the cylindrical body 1. The dispositions of the tips of the thin tubes are also such as to register with the positions of the vibrational nodes generated upon the inner circumferential surface of the cylindrical body 1 of the ultrasonic wave generator when the body 1 is subjected to the flexural vibrations, and furthermore, the tips of the thin tubes are directed so as to supply the liquid along the nodal lines upon the inner circumferential surface of the cylindrical body which is being subjected to the flexural vibrations.

Accordingly, the liquid atomizing apparatus utilizing an ultrasonic wave in accordance with the fifth embodiment of the present invention achieves the atomization of the liquid, as in the case with the third embodiment, by supplying the liquid through means of thin tubes E41 disposed along the nodal vibrational lines generated upon the inner circumferential surface of the vibratory member 1. The automatic control of the liquid films to an optimum thickness, as well as control of the atomizing area as a function of the amount of liquid being supplied, the atomization of a large amount of liquid with uniform particle size and distribution, and the provision of a desired amount of liquid to be atomized, is also readily achieved. In addition, the apparatus of the fifth embodiment permits the atomization of a large amount of liquid even within a small or restricted area, as in the case with the third embodiment.

Referring now to FIGS. 13(a) and 13(b), a sixth embodiment of a liquid atomizing apparatus utilizing ultrasonic waves, in accordance with the present invention, will be described in detail, the difference between such embodiment and the apparatus of the previous embodiments residing in the fact that in accordance with the sixth embodiment, the liquid is supplied to the cylindrical body 1 of the ultrasonic wave generator through means of a member made of a porous material affording a desirable degree of capillarity. Defined within the outer circumferential surface of an annular liquid supply ring D5 is an annular groove D51 having a substantially rectangular cross-section, and secured upon the outer circumferential surface of the liquid supply ring D5, in a closely fitting manner, is an outer ring E5 which covers the annular groove D51 so as to define with member D5 an annular liquid supply chamber, members D5 and E5 being bonded to each other by suitable means such as, for example, brazing.

The outer ring E5 is secured, at one portion of its outer circumferential surfacwe, to an end face F2 of a support rod F having a liquid supply passage F1 axially defined therethrough, the liquid supply passage F1 being in registry with a liquid inlet port E52 defined within the outer ring E5. The axis of the liquid supply ring D5 is in coincidence with the axis of the cylindrical body 1 of the ultrasonic wave generator and the ring D5 is seen to be secured to a support plate G of the liquid atomizing apparatus by means of the support rod F so as to be axially spaced a given distance from the upper end surface of the cylindrical body 1.

A plurality of pipes or conduits E51, of a small diametrical extent, extend parallel to the longitudinal axis of the cylindrical body 1 and are connected between the liquid supply ring D5 and the bottom end portion of the cylindrical body 1, one end of each of the pipes E51 being in fluidic communication with the annular groove D51 while the other end of each of the pipes is closed. The side wall surface of each of the pipes E51 which faces the cylindrical body 1 is also provided with a narrow, axially extending slit,l and a plate-type column E511, having a rectangular cross section and of small thickness, made of a porous material such as, for example, felt, so as to provide the desired capillarity, is secured within the aforenoted slit. The side surface E512 of the column E511 is in non-tensioned or non-pressured abutment with the circumferential surface of the cylindrical body 1 at the positions corresponding to the plurality of vibrational nodes which are generated upon the cylindrical body 1 when the latter is subjected to flexural vibrations.

The aforenoted porous member may also be made of glass fibers and asbestos, and/or other material which will facilitate achievement of the well-known purposes, and it is apparent that the apparatus of the sixth embodiment of the present invention may smoothly supply a liquid in widely ranging amounts through the aforenoted porous member and onto the outer circumferential surface of the cylindrical body being subjected to the flexural vibrations and along the nodal lines thereof. The liquid thus supplied is attracted onto the vibrating surface as a result of the ultrasonic vibration thereof so as to form liquid films thereon for obtaining the uniform atomization thereof, and it is to be noted that even if the liquid is supplied intermittently, uniform atomization may result. It should be additionally noted that the apparatus of the sixth embodiment may also permit the atomization of the liquid from the inner circumferential surface of the cylindrical body by supplying the liquid to the inner circumferential surface to the cylidrical body in the same manner as in the former cases.

Figure 14:
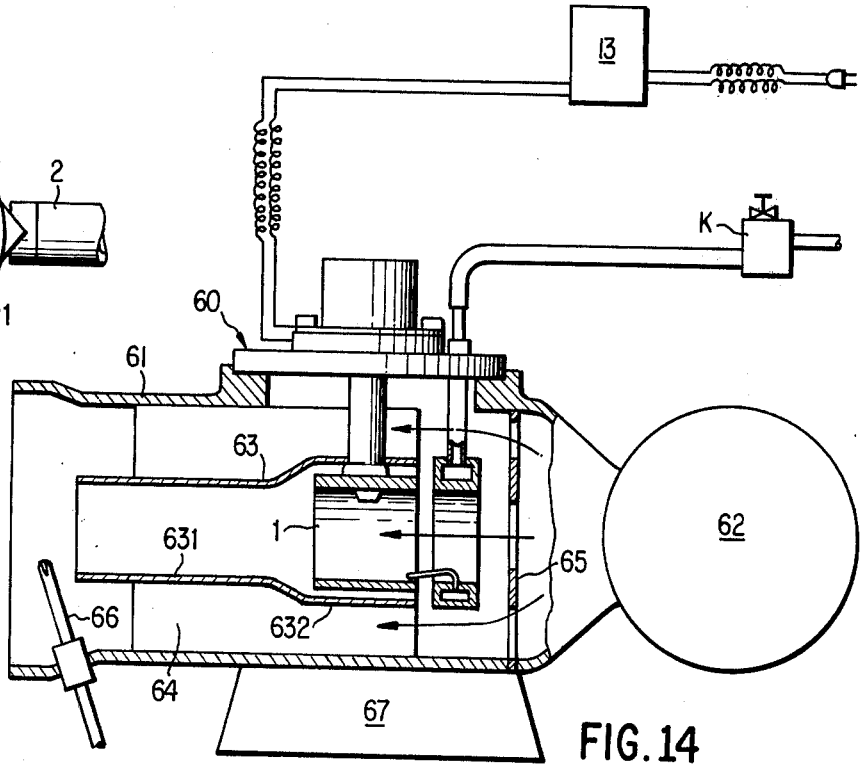
FIG. 14 is a schematic view of a combustion apparatus, to which the apparatus of the present invention may be applied.

With reference now being made to FIG. 14, a description will now be given of the case wherein a liquid atomizing apparatus utilizing an ultrasonic wave in accordance with the present invention may be applied to a liquid fuel combustion apparatus, and as is apparent from FIG. 14, the combustion apparatus utilizes the fifth embodiment of the present invention. Mounted upon the upper wall of a blower cylinder 61 of a liquid fuel combustion apparatus, generally indicated by the reference character 60, is a liquid atomizing apparatus utilizing an ultrasonic wave constructed in accordance with the present invention, a vibratory member 1 of a hollow cylindrical body of the aforenoted atomizing apparatus being disposed within the blower cylinder 61 with the axial line thereof being in coincidence with that of the blower cylinder.

One end of the blower cylinder 61 is open and has an increasing diametrical extent, while the other end has a decreasing diametrical extent and is connected to the exit of a blower 62. An atomized fuel guide cylinder 63 having both ends open is secured within cylinder 61 by means of a plurality of radially extending support plates 64 and it is seen that the atomized fuel guide cylinder 63 includes a cylinder portion having a small diameter and another cylinder portion connected thereto and having a large diameter, the large diameter cylinder portion encompassing the hollow cylinder 1 therewithin and having its longitudinal axis disposed in coincidence with the longitudinal axis of the hollow cylinder 1.

Disposed within the blower cylinder 61 at a position downstream of the blower 62 is a flow rate adjusting plate 65 which is adapted to adjust the flow rate of the air interiorly and exteriorly of the atomized fuel guide cylinder 63, and an ignition heater 66 is similarly disposed immediately downstream of the exit opening of the atomized fuel guide cylinder 63, a support for the liquid fuel combustion apparatus being designated at 67.

The operation of the liquid fuel combustion apparatus 60 will now be described hereunder. When the ultrasonic wave oscillator 13 is energized, the hollow cylindrical body 1 of the liquid atomizing apparatus utilizing an ultrasonic wave undergoes flexural vibration, and subsequently, when air is fed into the blower cylinder 61 of the combustion apparatus 60 by means of the blower 62 while the valve within the liquid amount-adjuster K is simultaneously opened so as to feed liquid fuel onto the inner circumferential surface of the hollow cylindrical body 1, the liquid fuel supplied to the inner circumferential surface of the body 1 is transformed into liquid films upon the vibrating surface of body 1 due to the ultrasonic vibration thereof.

The liquid films are then divided into groups of minute liquid particles, which process is followed by sprinking of the same within the cylindrical body so as to achieve the atomization of liquid, the process thereby presenting liquid paticles of a uniform size. The atomized fuel thus produced is then carried by means of the air stream generated by means of blower 62 and the same is discharged from the exit of the atomized fuel guide cylinder 63 so as to be ignited by means of the ignition heater 66. The fuel thus atomized continues its combustion once it has been ignited, and the atomized fuel will be burnt completely with the aid of the secondary air supplied co-axially along the outer circumference of the atomized fuel guide cylinder 63.

The combustion apparatus utilizing the liquid atomizing apparatus of the present invention and particularly the structural arrangment of the particularly noted embodiment thus facilitates the uniform and stabilized combustion as a result of the supply of atomized liquid fuel comprising particles of uniform size. In addition, as the vibratory member 1 of the hollow cylindrical body has a large vibrating surface, atomization of a large amount of liquid is rendered possible with the result that a wide range of combustion is able to be achieved. Furthermore, consistently stabilized atomization and combustion may be achieved by controlling the atomizing area and the film thickness of liquid fuel.

Figure 15:
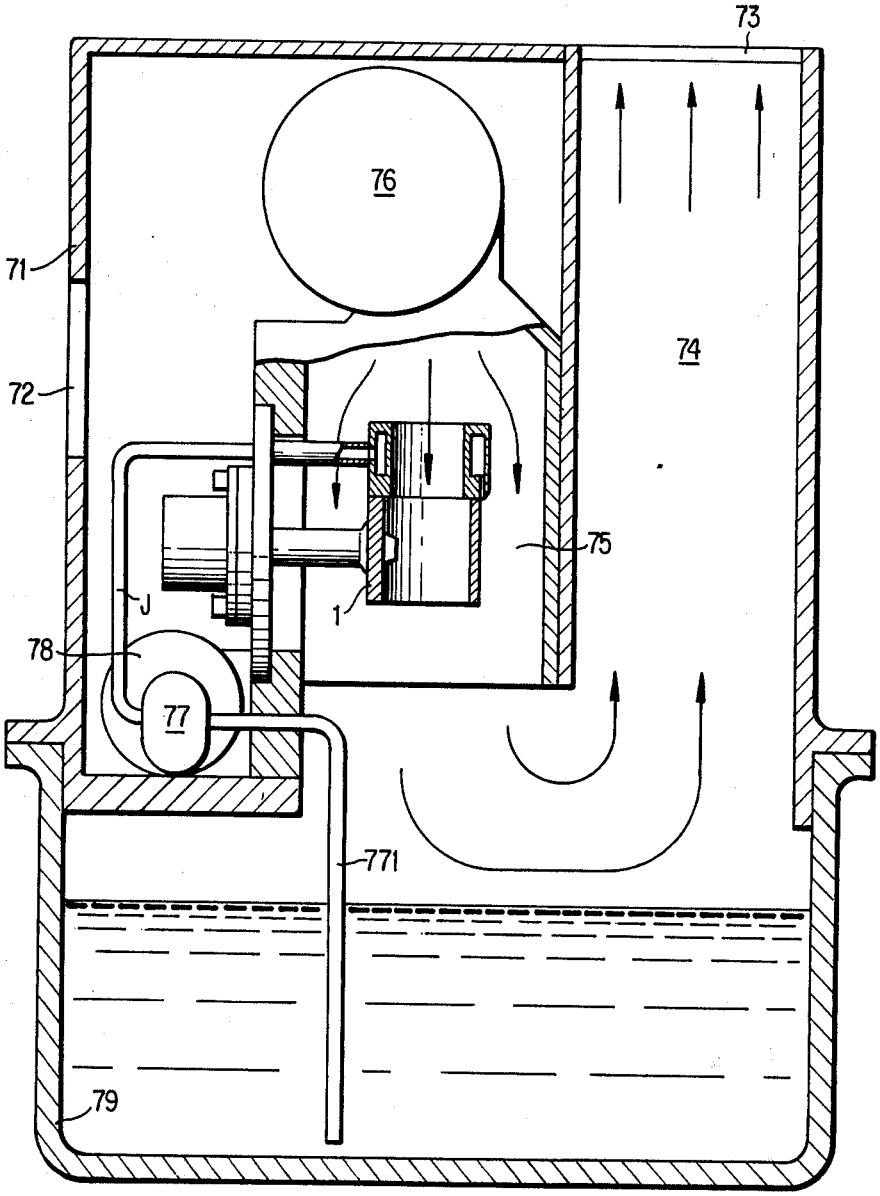
FIG. 15 is a schematic view of a humidifier apparatus to which the apparatus of the present invention may also be applied.

Turning now to FIG. 15, an application of the apparatus of the present invention to a humidifier will be described, and as apparent from FIG. 15, the humidifier apparatus or system utilizes the apparatus of the second embodiment of the present invention. In accordance with such a system, a casing or housing 71 is provided with an intake port 72 within a sidewall portion thereof and an exhaust cylinder 74 having an exhaust port 73 within its top wall member. Defined within the casing 71 by means of a partition member suspended from the top wall member of the casing is a water atomizing chamber 75, the upper end thereof being fluidically connected to the exit of a blower 76, and the lower end thereof being open. Mounted upon the side wall of the water atomizing chamber 75 is a liquid atomizing apparatus utilizing an ultrasonic wave in accordance with the present invention, which includes a vibratory member 1 of a hollow cylindrical body disposed within the water atomizing chamber 75 with its longitudinal axis being in coincidence with that of the water atomizingchamber 75, and mounted upon the lower side wall portion of the water atomizing chamber 75 is a motor 78 operatively connected to a gear pump 77. The casing 71 is disposed atop a water tub 79, and a water suction pipe 771 for use in conveying the water from the water tub to a liquid supply pipe J, by means of pump 77, is utilized for supplying water to the liquid atomizing apparatus.

In operation of the humidifier having the aforenoted structure, when the external ultrasonic wave oscillator, not shown, is energized, the hollow cylindrical body 1 of the liquid atomizing apparatus utilizing an ultrasonic wave undergoes flexural vibration. Upon air being introduced through the intake port 72 by means of the blower 76 and being conducted through the water atomizing chamber 75, while the gear pump 77 is simultaneously driven so as to feed water from the water tub 79 to the outer circumferential surface of the hollow cylindrical body 1 of the aforesaid apparatus, the water supplied to the outer circumferential surface is transformed into water films upon the vibrating surface of body 1 due to the ultrasonic vibration thereof. The films are thereupon divided into groups of minute water particles, followed by sprinkling and atomization of the same, in a manner similar to that previously described.

The water particles within the atomized fluid are then discharged as a result of being carried by the air being conducted from blower 76 and downwardly through the exit of the water atomizing chamber 75. In this manner, the water particles having a relatively large size accumulate within the water tub 79 in the lower portion of the apparatus, while on the other hand, water particles having a smaller size are carried by means of the air stream from the blower 76 with their direction of flow being altered after encountering the accumulated water within tub 79 so as to travel upwardly through the exhaust cylinder 74 of the humidifier so as to be discharged exteriorly of the apparatus through the exhaust port 73 thereby adding moisture to the air. The humidifier constructed in accordance with this embodiment thus provides uniform moisture conditions over a wide humidity range, depending upon the amount of water being supplied.

Within the aforenoted embodiments and applications according to the present invention, a magnetostrictive element and piezoelectric elements have been utilized as the ultrasonic wave transducers, however, the present invention is by no means limited to such structures, and thus any modification affording the same function may be effectively employed. In addition, even in the instances of those embodiments wherein piezoelectric elements or a magnetostrictive element is employed, those embodiments are only one of the many instances possible, and thus, many other modifications may be effected.

Similarly, within those embodiments wherein the detailed description has been given of the apparatus which included a conical type horn and/or a stepped type horn as the mechanical vibration amplifying portion, the present invention is likewise by no means limited to those examples, and thus, any type of structure which may suitably amplify the mechanical vibrations may of course be utilized, such as, for example, an exponential type horn, a Fourier type horn, a catenary type horn or the like.

Still further, within those embodiments within which a hollow elliptical or cylindrical body was employed as the vibratory member, the present invention is of course not limited to those examples. More particularly, any hollow annular body having a small and constant wall thickness may be utilized as the vibratory member, and it is immaterial whether the configuration of the same is cylindrical, elliptical, polygonal, or the like. A rectangularly shaped thin sheet of a given thickness and area dimension may in fact be bent and formed so as to provide an annular portion and a joint portion, the joint portion of course being integrally secured to the output end of the mechanical vibration amplifying portion by suitable means, such as, for example, welding. In addition, it should also be noted that what is meant by the term "constant thickness" is that the thickness of the body does not vary throughout the axial or longitudinal extent thereof, however, the thickness may vary from one circumferential location to another. In this manner, the vibrational displacement is constant axially of the vibratory member.

With respect to the description of the liquid supply means wherein, for example, the liquid is supplied from a liquid source and metered to a predetermined amount, and is then directly supplied to the vibratory member through means of a pipe secured to the housing, or in accordance with another example, the liquid is supplied through means of a pipe to an annular ring and is then supplied to the nodal positions of flexural vibration upon the vibratory member through means of a plurality of grooves or small diameter pipes provided upon the aforenoted ring, the present invention is by no means limited to such exemplary structures, but to the contrary, various alterations and modifications may be effected as means for supplying the liquid to the vibratory member. In other words, the number and arrangement of the components within the aforenoted embodiments may be varied as required, and the position and angles of the liquid being supplied to the vibratory member may also be designed to an optimum condition, as required.

Within the aforenoted embodiments, while it has been noted that liquid is supplied to either the inner or outer circumferential surface of the vibratory member, the liquid may simultaneously be supplied to both the inner and outer circumferential surfaces for increasing the amount of liquid being atomized. Yet further, while a combustion apparatus and a humidifier system have been disclosed as examples of applications utilizing the liquid atomizing apparatus of the present invention, the present invention is by no means limited to such examples, but may be applied, for example, to an instance wherein a muddy slurry is to be atomized within a granulator, or where paint is to be atomized within a painting device or the like.

In summary, the present invention, as embodied within the first embodiment, includes an ultrasonic wave transducer, a mechanical vibration amplifying portion, a vibratory member of a hollow cylindrical body of small wall thickness, and a liquid supplying means, such apparatus facilitating uniform and stable atomization of the liquid as well as the atomization of a large amount of liquid as a result of employing a vibratory member having a large vibrating surface. Effective control of the amount of liquid to be atomized is also attained.

Still further, in accordance with the present invention as embodied within the second embodiment thereof, a vibratory member is subjected to flexural vibration while a liquid is supplied from the liquid supply means to the positions of the vibrational nodes upon the vibratory member whereby optimum liquid films are automatically formed upon the vibrating surface, depending upon the amplitude of vibration of the vibratory member, and the atomizing area of the vibratory member may be selectively controlled depending upon the amount of liquid being supplied. In this manner, stabilized and uniform atomization results, while the sprinkling of liquid particles having a large size, such as experienced within the prior art liquid atomizing apparatus, is effectively prevented.

Still yet further in accordance with the present invention as embodied within the third embodiment thereof, the liquid is supplied, through means of a porous material having a desired degree of capillarity, to the vibratory member, whereby a particular amount of liquid, selected from a wide quantity range, may be supplied and uniformly atomized, and even if the liquid is supplied intermittently, there may be achieved stable atomization.

Obviously, many other modifications and variations of the present invention are also possible in light of the above teachings. It is to be understood therefore that within the scope of the appended claims, the present invention may be practiced otherwise than as specifically described herein.

What is claimed as new and desired to be secured by Letters Patent of the United States is:

1. A liquid atomizing apparatus comprising:

an ultrasonic wave oscillator;

an ultrasonic wave transducer connected to said ultrasonic wave oscillator for transforming an electrical oscillation of said oscillator into a mechanical vibration;

a mechanical vibration amplifying member integrally connected to one end of said ultrasonic wave transducer for amplifying the amplitude of said mechanical vibration transmitted from said ultrasonic wave transducer;

an ultrasonic vibratory member of a hollow annular body being open at both ends thereof, being circular in radial cross-section, having a predetermined length between said ends thereof, having a predetermined wall thickness which is constant in the axial direction of said annular body, and being integrally connected, at an outer circumferential side wall portion thereof, to the output end of said mechanical vibration amplifying member with the axis thereof being disposed perpendicular to the axis of said mechanical vibration amplifying member; and liquid supply means connected to a liquid source for supplying a predetermined amount of liquid to at least one of the outer and inner circumferential surfaces of said ultrasonic vibratory member, whereby said liquid supplied to said circumferential surface of said ultrasonic vibratory member upon said circumferential surface of said ultrasonic vibratory member may be atomized as a result of the ultrasonic vibration thereof.

2. A liquid atomizing apparatus according to claim 1, wherein:

said ultrasonic wave transducer is a piezoelectric type transducer.

3. A liquid atomizing apparatus according to claim 1, wherein:

said ultrasonic wave transducer is a magnetostrictive type transducer.

4. A liquid atomizing apparatus according to claim 1, wherein:

said mechanical vibration amplifying member is a conical horn.

5. A liquid atomizing apparatus according to claim 1, wherein:

said mechanical vibration amplifying member is a stepped horn.

6. A liquid atomizing apparatus according to claim 1, wherein:

said mechanical vibration amplifying member is an exponential horn.

7. A liquid atomizing apparatus according to claim 1, wherein:

said mechanical vibration amplifying member is a Fourier horn.

8. A liquid atomizing apparatus according to claim 1, wherein:

said mechanical vibration amplifying member is a catenary horn.

9. A liquid atomizing apparatus according to claim 1, wherein:

said ultrasonic vibratory member is a hollow cylinder.

10. A liquid atomizing apparatus according to claim 1, wherein:

said ultrasonic vibratory member is a hollow polygonal column having a small wall thickness.

11. A liquid atomizing apparatus according to claim 1, wherein:

said ultrasonic vibratory member is a rectangularly shaped thin sheet of a given dimension bent and formed so as to provide a cylindrical portion and a joint portion integrally welded to the output end of said mechanical vibration amplifying member.

12. A liquid atomizing apparatus according to claim 1, wherein:

said ultrasonic vibratory member is a hollow cylinder having an axially extending slit-like opening provided within the side-wall portion disposed opposite the side wall portion fixed to said mechanical vibration amplifying member.

13. A liquid atomizing apparatus according to claim 1, wherein:

said liquid supply means is a pipe member having an opening of a predetermined diameter connected to said liquid source.

14. A liquid atomizing apparatus according to claim 1, wherein:

said liquid supply means includes means for supplying a predetermined amount of liquid to said outer circumferential surface of said vibratory member.

15. A liquid atomizing apparatus according to claim 1, wherein:

said liquid supply means includes means for supplying a predetermined amount of said liquid to said inner circumferential surface of said vibratory member.

16. A liquid atomizing apparatus according to claim 1, wherein:

said liquid supply means includes means for supplying a predetermined amount of said liquid to both of said outer and inner circumferential surfaces of said vibratory member.

17. A liquid atomizing apparatus according to claim 1, wherein said liquid supply means comprises:

means connected to said liquid source for supplying a predetermined amount of said liquid to at least one of said outer and inner circumferential surfaces of said vibratory member through means of a member comprising a porous material and abutting said circumferential surface, whereby said liquid is smoothly supplied to said circumferential surface and is atomized upon said circumferential surface of said vibratory member.

18. A liquid atomizing apparatus according to claim 9, wherein:

said ultrasonic wave oscillator is so constructed as to feed electrical oscillations having a predetermined frequency, and said ultrasonic wave transducer, said mechanical vibration amplifying member, and said ultrasonic vibratory member are so constructed as to have predetermined dimensions such that said circumferential surface of said ultrasonic vibratory member is subjected to flexural vibration.

19. A liquid atomizing apparatus according to claim 18, wherein:

said liquid supply means includes a hollow annular member having at least two slit-like groove means for supplying to said ouer circumferential surface of said vibratory member a predetermined amount of said liquid along nodal lines of said flexural vibration impressed upon said circumferential surface.

20. A liquid atomizing apparatus according to claim 18, wherein:

said liquid supply means includes a hollow annular member having at least two tube members each with an opening of a predetermined diameter for supplying to said outer circumferential surface of said vibratory member a predetermined amount of said liquid along nodal lines of said flexural vibration impressed upon said circumferential surface.

21. A liquid atomizing apparatus according to claim 18, wherein:

said liquid supply means includes a hollow annular member having at least two slit-like groove means for supplying to said inner circumferential surface of said vibratory member a predetermined amount of said liquid along nodal lines of said flexural vibration impressed upon said circumferential surface.

22. A liquid atomizing apparatus according to claim 18, wherein:

said liquid supply means includes a hollow annular member having at least two tube members each with an opening of a predetermined diameter for supplying to said inner circumferential surface of said vibratory member a predetermined amount of said liquid along nodal lines of said flexural vibration impressed upon said circumferential surface.

23. A liquid atomizing apparatus according to claim 13, wherein:

said ultrasonic wave transducer is a magnetostrictive type transducer;

said mechanical vibration amplifying member is a conical horn; and said ultrasonic vibratory member is a hollow cylinder.

24. A liquid atomizing apparatus according to claim 23, wherein:

said hollow cylinder includes an elliptical, hollow cylindrical body of small wall thickness with its axis being disposed perpendicular to the axis of said conical horn and with a portion of its outer circumferential wall surface being secured to the tip portion of said conical horn by means of a bolt and a washer; and said liquid supply means includes a liquid supply amount-adjusting means adapted to supply a predetermined amount of said liquid from a pumping means, a liquid supply pipe secured to a housing by means of a nut and connected to said adjusting means, and a hollow pipe fluidically connected with said liquid supply pipe and having an opening which is directed downwardly at a predetermined angle toward the upper effective atomizing portion of said vibratory member.

25. A liquid atomizing apparatus according to claim 18, wherein:

said mechanical vibration amplifying member is a stepped horn.

26. A liquid atomizing apparatus according to claim 25, wherein:

said ultrasonic wave transducer is a piezoelectric type transducer.

27. A liquid atomizing apparatus according to claim 26, wherein:

said liquid supply means includes a hollow annular member having at least two slit-like grooves for supplying a predetermined amount of said liquid to said outer circumferential surface of said vibratory member along nodal lines of said flexural vibration impressed upon said circumferential surface.

28. A liquid atomizing apparatus according to claim 27, wherein:

said ultrasonic wave transducer includes a cylindrical metal backing block having a flange, a ring-shaped support plate fitted upon a flange of said stepped horn for reinforcing the bending rigidity of said flange of said horn, circular piezoelectric elements interposed between said horn and said backing block, an electrode plate and an annular spacer plate likewise interposed between said stepped horn and backing block and operatively secured therewith through bolt means;

said vibratory member of said hollow cylindrical body is formed upon its circumferential surface with a columnar portion or rib having a large wall thickness in cross section and which is integral with said cylindrical body over the entire axial length thereof, said rib or column extending parallel to the longitudinal axis of said cylindrical body and being formed with a hole adapted to receive therethrough a bolt having a truncated conical head; and said liquid supply means includes said hollow annular member, disposed upon the upper end of said vibratory member, which in turn includes an inner ring having an annular groove of rectangular cross section formed upon the outer surface thereof, an outer ring of small thickness having eight slit-like grooves circumferentially positioned, at points corresponding to eight nodal positions of said vibratory member, upon the inner surface thereof, a hollow support rod connected to said outer ring, a support plate for supporting said hollow support rod by means of a locking screw, a liquid supply pipe fixed to said support plate and fluidically connected to said hollow support rod, a liquid supply amount-adjusting means, and said liquid source.

29. A liquid atomizing apparatus according to claim 26, wherein:

said liquid supply means includes a hollow annular member having at least two slit-like grooves for supplying a predetermined amount of said liquid to said inner circumferential surface of said vibratory member along nodal lines of said flexural vibration impressed upon said circumferential surface.

30. A liquid atomizing apparatus according to claim 29, wherein:

said ultrasonic wave transducer includes a cylindrical metal backing block having a flange, a ring-shaped support plate fitted upon a flange of said stepped horn for reinforcing the bending rigidity of said flange of said horn, circular piezoelectric elements interposed between said horn and said backing block, an electrode plate and an annular spacer plate likewise interposed between said stepped horn and backing block and operatively secured therewith through bolt means;

said vibratory member of said hollow cylindrical body is formed upon its circumferential surface with a columnar portion or rib having a large wall thickness in cross section and which is integral with said cylindrical body over the entire axial length thereof, said rib or column extending parallel to the longitudinal axis of said cylindrical body and being formed with a hole adapted to receive therethrough a bolt having a truncated conical head; and said liquid supply means includes said hollow annular member, disposed upon the upper end of said vibratory member, which in turn includes an outer ring having an annular groove of rectangular cross section formed upon the inner surface thereof and an inner ring of small thickness having eight slit-like grooves circumferentially positioned, at points corresponding to eight nodal positions of said vibratory member, upon the outer surface thereof, a hollow support rod connected to said outer ring, a support plate for supporting said hollow support rod by means of a locking screw, a liquid supply pipe fixed to said support plate and fluidically connected to said hollow support rod, a liquid supply amount-adjusting means, and said liquid source.

31. A liquid atomizing apparatus according to claim 16, wherein:

said liquid supply means includes a hollow annular member having at least two tube members each with an opening of a predetermined diameter for supplying a predetermined amount of said liquid to said outer circumferential surface of said vibratory member along nodal lines of said flexural vibration upon said circumferential surface.

32. A liquid atomizing apparatus according to claim 31, wherein:

said ultrasonic wave transducer includes a cylindrical metal backing block having a flange, a ring-shaped support plate fitted upon a flange of said stepped horn for reinforcing the bending rigidity of said flange of said horn, circular piezoelectric elements interposed between said horn and said backing block, an electrode plate and an annular spacer plate likewise interposed between said stepped horn and said backing block and operatively secured therewith through bolt means;

said vibratory member of said hollow cylindrical body is formed upon its circumferential surface with a columnar portion or rib having a large wall thickness in cross section and which is integral with said cylindrical body over the entire axial length thereof, said rib or column extending parallel to the longitudinal axis of said cylindrical body being formed with a hole adapted to receive therethrough a bolt having a truncated conical head; and said liquid supply means includes said hollow annular member, disposed upon the upper end of said vibratory member, which in turn includes an inner ring having an annular groove of rectangular cross-section formed upon the outer surface thereof, an outer ring of small thickness having six thin tubes connected to said annular groove and circumferentially positioned at points corresponding to six nodal positions of said vibratory member, upon said inner surface thereof, a hollow support rod connected to said outer ring, a support plate for supporting said hollow support rod by means of a locking screw, a liquid supply pipe fixed to said support plate and fluidically connected to said hollow support rod, a liquid supply amount-adjusting means, and said liquid source.

33. A liquid atomizing apparatus according to claim 26, wherein:

said liquid supply means includes a hollow annular member having at least two tube members each with an opening of a predetermined diameter for supplying a predetermined amount of said liquid to said outer circumferential surface of said vibratory member along nodal lines of said flexural vibration impressed upon said circumferential surface.

34. A liquid atomizing apparatus according to claim 33, wherein:

said ultrasonic wave transducer includes a cylindrical metal backing block having a flange, a ring-shaped support plate fitted upon a flange of said stepped horn for reinforcing the bending rigidity of said flange of said horn, circular piezoelectric elements interposed between said horn and said backing block, an electrode plate and an annular spacer plate likewise interposed between said stepped horn and said backing block and operatively secured therewith through bolt means;

said vibratory member of said hollow cylindrical body is formed upon its circumferential surface with a columnar portion or rib having a large wall thickness in cross section and which is integral with said cylindrical body over the entire axial length thereof, said rib or column extending parallel to the longitudinal axis of said cylindrical body and being formed with a hole adapted to receive therethrough a bolt having a truncated conical head; and said liquid supply means includes said hollow annular member, disposed upon the upper end of said vibratory member, which in turn includes an outer ring having an annular groove of rectangular cross-section formed upon the inner surface thereof, an inner ring of small thickness having six thin tubes connected to said annular groove and circumferentially positioned at points corresponding to six nodal positions of said vibratory member, upon said outer surface thereof, a hollow support rod connected to said outer ring, a support plate for supporting said hollow support rod by means of a locking screw, a liquid supply pipe fixed to said support plate and fluidically connected to said hollow support rod, a liquid supply amount-adjusting means, and said liquid source.

35. A liquid atomizing apparatus according to claim 26, wherein:

said liquid supply means includes means connected to said liquid source for supplying a predetermined amount of said liquid to at least one of the outer and inner circumferential surfaces of said vibratory member through means of a member comprising a porous material and abutting said circumferential surface, whereby said liquid is smoothly supplied to said at least one of said circumferential surfaces, and said liquid is atomized upon said at least one of said circumferential surfaces of said vibratory member.

36. A liquid atomizing apparatus according to claim 35, wherein:

said ultrasonic wave transducer includes a cylindrical metal backing block having a flange, a ring-shaped support plate fitted upon a flange of said stepped horn for reinforcing the bending rigidity of said flange of said horn, circular piezoelectric elements interposed between said horn and said backing block, an electrode plate and an annular spacer plate likewise interposed between said stepped horn and said backing block and operatively secured therewith through bolt means;

said vibratory member of said hollow cylindrical body is formed upon said at least one of said circumferential surfaces with a columnar portion or rib having a large wall thickness in cross section and which is integral with said cylindrical body over the entire axial length thereof, said rib or column extending parallel to the longitudinal axis of said cylindrical body and being formed with a hole adapted to receive therethrough a bolt having a truncated conical head; and said liquid supply means includes said hollow annular member, disposed a predetermined distance above said vibratory member, which in turn includes an inner ring having an annular groove of rectangular cross-section formed upon the outer surface thereof and circular openings circumferentially positioned at points corresponding to nodal positions of said vibratory member disposed upon the bottom wall thereof an outer ring of small thickness, operatively connected to said inner ring, a plurality of small diameter pipes respectively connected to said circular openings of said inner ring and extending parallel to the longitudinal axis of said vibratory member and a narrow, axially extending slit defined within the side surface of each of said pipes, and a square column, having a rectangular cross section and small thickness and made of a felt-type porous material for affording capillarity, being fitted within said narrow slit.

* * * * *